United States Patent [19]

Tosches

[11] 3,978,897

[45] Sept. 7, 1976

[54] WEFT EXTENDING CARRIER

[75] Inventor: Anthony J. Tosches, Milford, Mass.

[73] Assignee: Rockwell International Corporation, Pittsburgh, Pa.

[22] Filed: June 6, 1975

[21] Appl. No.: 584,267

[52] U.S. Cl. ..... 139/448

[51] Int. Cl.[2] ..... D03D 47/20

[58] Field of Search ..... 139/122 N, 122 R, 123, 139/127 R, 447, 448

[56] References Cited

UNITED STATES PATENTS

| | | | |
|---|---|---|---|
| 2,960,118 | 11/1960 | Ancet et al. | 139/122 N |
| 3,532,136 | 10/1970 | Golobart | 139/122 N |
| 3,874,421 | 4/1975 | Mackie | 139/122 N |

FOREIGN PATENTS OR APPLICATIONS

| | | | |
|---|---|---|---|
| 482,852 | 1/1970 | Switzerland | 139/122 N |

*Primary Examiner*—James Kee Chi

[57] ABSTRACT

A weft extending carrier for shuttleless looms adapted to insert single picks of weft into separate sheds formed by warp threads. The carrier is provided with an elongated weft finger one end of which is pivotally supported in the trailing end of the carrier and the opposite end defines a weft engaging recess or retaining hook that is biased in a direction to continuously urge the latter into a pocket formed in the leading end of the carrier. The retaining hook, in timed sequence with the weaving cycle is cammed outwardly from the pocket to release the pick of weft held thereby and provides a carrier which can accommodate a wider range of different types of weft than has been heretofor possible as well as providing a self cleaning feature that prevents the accumulation of lint in the gripping area of the carrier.

1 Claim, 6 Drawing Figures

18
28
24
31
15
19
21
23
30
13
12
22
26
16
11
14
25
27
10

29
3
11
13
15
28
30
12
20
10
17
24
14
3

30
13
25
14
29

15
17
29
24
13
18

15
17
29
24
13
18

10
12
20
25
13
18
24
29
21
31
32
11
30
17
15
33

WEFT EXTENDING CARRIER

BACKGROUND OF THE INVENTION

1. Field of the Invention

In shuttleless looms which utilize weft yarn that is furnished from an outside source and is not carried to and fro through the shed by the shuttle or carrier itself, it is common practice to insert each pick of weft by two reciprocating elements. That element which introduces the weft into the warp shed is known as the inserting carrier and that which receives or has transferred to it the introduced weft to be drawn through the remainder of the shed is known as the weft receiving or extending carrier.

The shuttleless loom to which the instant invention is applicable is of the single pick insertion type wherein the weft yarn remains threaded through an eyelet in the rear wall of the inserting carrier and extends in one direction to its source of supply and in the other direction to the selvage or fabric edge. When forming single picks the weft yarn must be clamped, held, then cut adjacent the shed each time the inserting carrier is withdrawn from said shed. During the initial movement of the inserting carrier to introduce a pick of weft, the latter is located in such a manner so is to be caught by a clamping element in the forward wall of the inserting carrier and the clamped weft is then released to permit said carrier to carry the cut end of weft into the shed and present it to the extending carrier. In particular the invention pertains to an improved extending carrier for receiving an end of weft from the inserting carrier and to draw the same through the shed to complete a single pick.

2. Description of the Prior Art

The known forms of weft extending carriers for shuttleless looms of the pick and pick insertion type have an elongated configuration with upper and lower surfaces disposed in spaced and aligned relation which join at the carrier's leading end to form a weft engaging hook. At the opposite or trailing end of the carrier the upper surface tapers downwardly and joins with the lower surface to form a means for deflecting the warp yarns during withdrawal of the carrier from a warp shed. In the space intermediate the upper and lower surfaces, the carrier is provided with a gripper finger pivotably assembled intermediate its ends and extends for substantially the length of the space provided between said surfaces.

A biasing means continuously urges the forward end of the gripper finger into contact with the weft engaging hook of the carrier, the combination of which includes a tongue and groove arrangement for holding the pick of weft as it is extended through the shed. The tongue portion of the combination forms an integral part of the finger and the groove of conforming configuration is formed on the inner side of the hook. A lip is provided at the trailing end of the gripper finger which protrudes from the side of the carrier and serves in a known manner as a means for effecting pivotal movement of the gripper finger so as to release the weft held thereby in timed sequence with the weaving cycle.

This form of extending carrier has performed its intended function satisfactorily; however, it has presented problems which are considered undesireable and time consuming to correct. The assembly and setting of the gripper finger is quite critical for the tongue and groove arrangement formed by the hook and gripper finger must be accurately aligned in order to effect transfers of the weft from one carrier to the other as well as to maintain the required grip on the weft as it is being extended through the shed. With the weft engaging hook forming an integral part of the carrier's leading end, there is no means of shedding or preventing the accumulation of lint in the weft gripping area of the carrier. As is well known to those conversant in the weaving art certain types of weft yarn are more troublesome than others in this respect and the build up of lint between the hook and gripper finger will cause the latter to fail to hold the weft as well to effect its transfer from one carrier to the other.

Additionally with the weft engaging hook forming an integral part of the carriers body portion the distance the gripper finger is capable of being pivoted within said body portion is quite limited and very definitely limits the size and types of weft yarn with which this type of extending carrier can function satisfactorily.

The improved weft extending carrier has reduced substantially the problems experienced with the known form of extending carriers by providing a carrier in which the pivotable portion thereof includes the weft engaging and retaining hook which makes the assembly of said pivotable portion far less critical than the so-called gripper finger of known type carriers. Additionally the instant carrier possesses a self cleaning feature which will not permit the accumulation of lint and provides greater pivotal movement of its pivotable portion whereby said carrier can successfully accommodate a far broader range of types of weft than carriers of the known type.

SUMMARY OF THE INVENTION

The weft extending carrier for shuttleless looms of the present invention includes a base portion or trailing end having an elongated shank defining a top and bottom surface extending therefrom which interconnect, one with the other, to form the carriers leading tip. This leading tip is provided with a pocket that communicates with the side thereof into and from which a weft engaging recess or retaining hook formed on one end of a weft finger is pivotable. The weft finger is an elongated member which pivotably assembles within the space formed between the top and bottom surfaces and includes and arcuated actuating surface adjacent that end opposite the weft retaining hook. This weft finger is spring biased so as to continuously urge its weft retaining hook into the leading end's pocket and the acruated actuating surface thereof is adapted to be engaged by a fixed guide on the loom in timed sequence with the weaving cycle so as to pivot said hook from the pocket and release the weft being held thereby.

It is a general object of the invention to improve the general construction and operational characteristics of the weft extending carrier herein described.

It is a further object of the invention to provide an extending carrier having means for preventing the accumulation of lint in the weft gripping area thereof.

A further object is that of providing an extending carrier which can accomodate a greater number of types of weft yarn than has been possible with known types of extending carriers.

These and other objects of the invention will become more fully apparent by reference to the appended claims and as the following detailed description proceeds in reference to the figures of drawing wherein:

DESCRIPTION OF THE PREFERRED EMBODIMENT

Now referring to the figures of drawing inserters or flexible tapes 10 are used to reciprocate the weft carrying members themselves which are caused to enter the shed and to be withdrawn therefrom. The tapes are projected into the shed to a point approximately adjacent the center thereof at which the weft extending carrier meets the inserting carrier to transfer the weft yarn to be drawn through the remainder of the shed.

Figure 1:
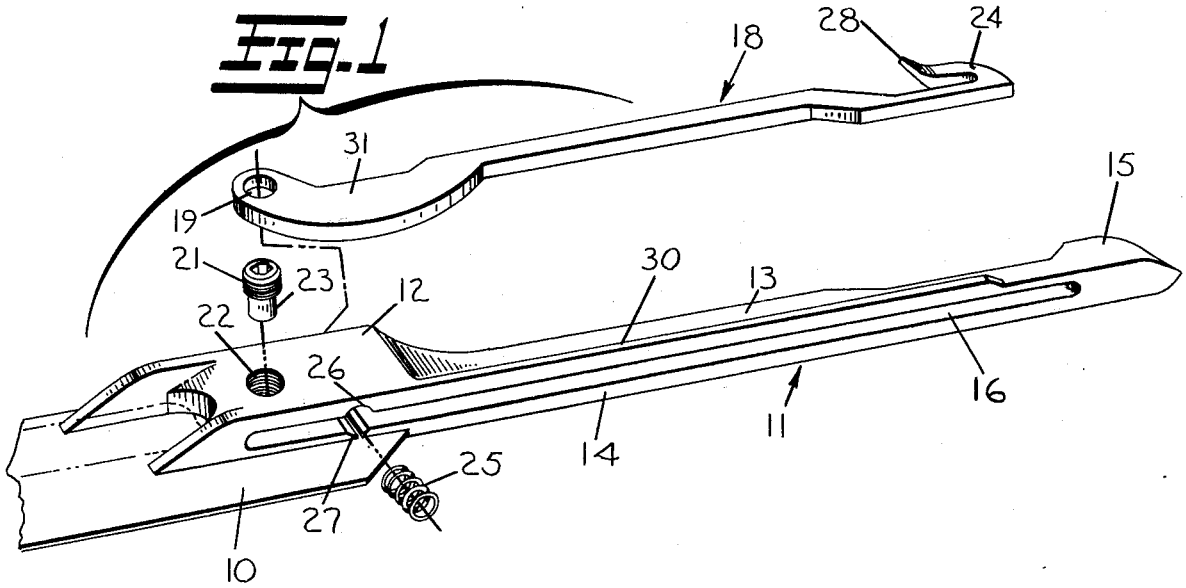
FIG. 1 is a perspective view in exploded form showing the various elements of the extending carrier comprising the invention.
Figure 2:
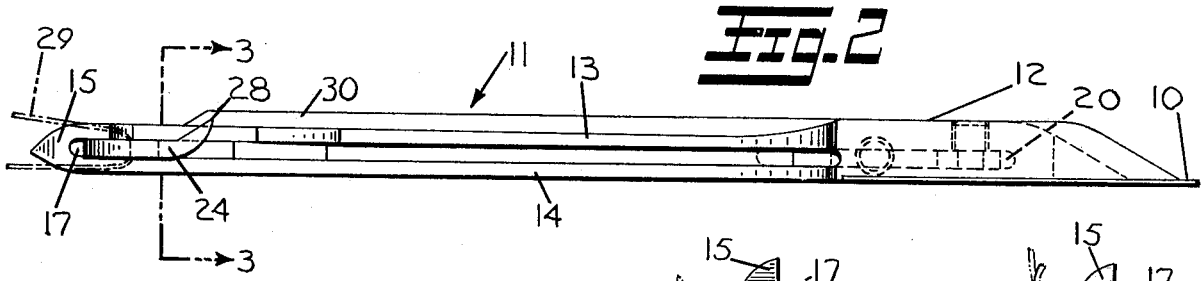
FIG. 2 is a view in side elevation of the extending carrier.
Figure 3:
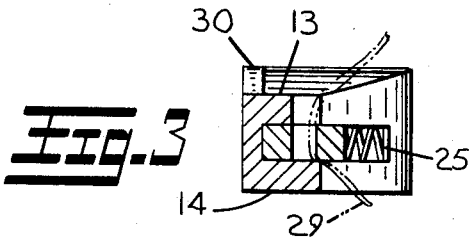
FIG. 3 is a sectional view taken along line 3—3 in FIG. 2.
Figure 5:
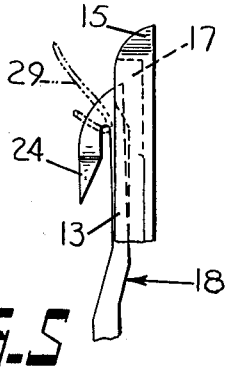
FIG. 5 is a top view of the carrier's leading end showing the position of the weft finger's retaining hook when gripping the weft.
Figure 4:
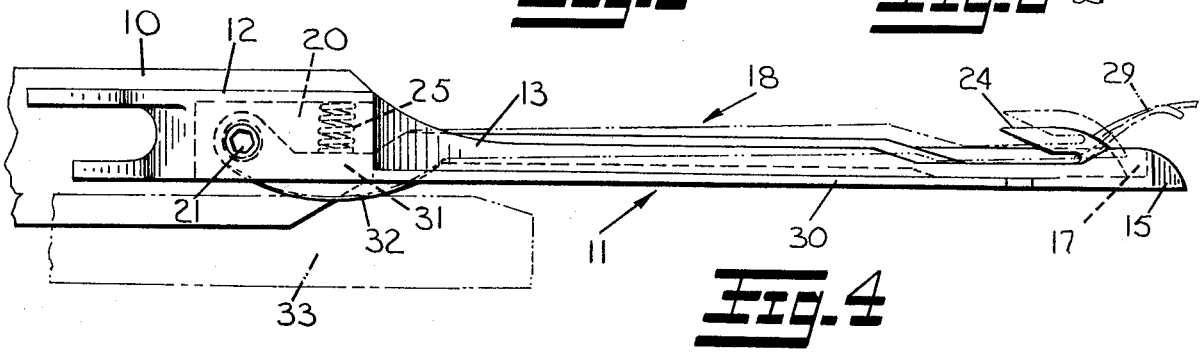
FIG. 4 is a top view of the carrier in FIG. 3 showing the fixed guide means on a loom for effecting pivotal movement of the weft finger.

Attached by some suitable means to the tape 10 is a weft receiving or extending carrier generally indicated by numeral 11 (FIGS. 1, 2 and 4). In these figures of drawing the carrier's base portion is identified by numeral 12 and includes an elongated shank that defines a top and bottom surface 13 and 14 respectively extending therefrom. Spaced from the base portion 12, the top and bottom surfaces 13 and 14 are interconnected to form the carriers leading end or tip 15. The space intermediate the top and bottom surfaces defines an elongated opening or recess 16 (FIG. 1) which terminates within the leading end 15 of the carrier in the form of a pocket 17 which serves a purpose yet to be described.

An elongated weft finger identified generally by numeral 18 is provided adjacent one end with an aperture 19 (FIG. 1) which provides a means to pivotably assemble said finger in the elongated opening 16 of the carrier. Opening 16 extends into the base portion 12 and forms a pocket 20 (FIG. 4) within which the weft finger is mounted by means of threaded pin 21. This pin 21 is assembled in a threaded hole 22, provided in the top of the base portion 12 and includes a shank portion 23 which serves as a fulcrum for the weft finger 18.

Figure 6:
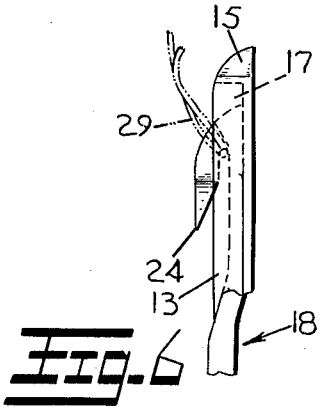
FIG. 6 is a view similar to FIG. 5 but showing the position the hook is caused to assume to release the weft held thereby.

That end of the weft finger 18 opposite the aperture 19 is provided with an integrally formed weft retainng hook 24 and in assembled position within opening 16 said hook is continuously urged to a seated position in pocket 17 such as shown in FIG. 6 and the solid line position depicted in FIG. 4. The means for biasing the weft retaining hook in this direction is a coil spring 25 assembled within a pair of opposed recesses 26 and 27 (FIG. 1) formed in the base portion 12 which communicate with the elongated opening 16 in the carrier. As shown in FIG. 4, coil spring 25 is disposed so that one end engages the side of the weft finger 18 adjacent its pivot point and the opposite and engages one side of pocket 20 within the base portion 12.

As shown in FIGS. 1 and 2 the terminus portion of the weft retaining hook 24 is directed generally upwardly as at 28 and serves as a means for engaging and effecting positive transfer of weft 29 when the carriers meet for that purpose within a warp shed.

With reference to FIGS. 1, 2 and 4, the top surface 13 is shown provided with an upwardly directed rib 30 which extends along said top surface for a substantial portion of its length and serves to prevent the terminus portion 28 of the retaining hook 24 from interfering with the warp threads as the carrier is being withdrawn from a warp shed.

In FIGS. 1 and 4 that portion of the weft finger 18 immediately adjacent to that end pivotally mounted in the base portion 12, is shown formed with an off set portion or arcuated actuating surface 31 which protrudes from the opening 16 as at 32. This surface which protrudes from the opening 16 is disposed so as to contact a guide 33 (FIG. 4) fixed at the side of the loom and is effective in causing pivotal movement of the weft finger whereby the weft retaining hook 24 is moved from the solid to phantom line position shown in FIG. 4 permitting the weft 29 being held thereby to be released.

To summarize the operation the carrier enters the warp shed and meets the inserting carrier adjacent the center thereof. When the two carriers meet, the end of weft introduced by the inserting carrier slips over the top or terminus portion of the retaining hook 24 of the extending carrier. As the extending carrier reverses its direction of travel, the weft yarn becomes wedged between the underside of the retaining hook and the immediately adjacent portion of the lower surface 14. The extending carrier draws the end of weft through the remainder of the shed to complete the pick and as it leaves the shed the arcuated actuating surface 31 contacts the guide 33 fixed at the side of the loom. Guide 33 is effective in causing the weft finger to pivot to a position which locates the retaining hook 24 in the phantom line position shown in FIG. 4. When the retaining hook 24 pivots to this position its grip on the weft is lost and further movement of the carrier releases the weft therefrom.

Although the present invention has been described in connection with a preferred embodiment, it is to be understood that modifications and variations may be resorted without departing from the spirit and scope of the invention as those skilled in the art will readily understand. Such modifications and variations are considered to be within the purview and scope of the invention and the appended claims.

What is claimed is:

1. An improved weft extending carrier for a loom having weft carriers attached to reciprocable inserter members by which weft from an outside source of supply is inserted as single picks into separate sheds of warp threads, the extending carrier receiving an end of weft from an inserting carrier and extending the end of weft across the remainder of the shed, said extending carrier comprising:

a. a base portion for attachment to a reciprocable inserter member;

b. an elongated shank extending outwardly from said base portion in a direction away from the inserter member, said elongated shank having means defining a recess which extends substantially the entire length thereof;

c. an elongated weft finger mounted for pivotal movement into and from said recess;

d. means on that end of said weft finger away from said base portion to define a weft engaging recess and to cooperate with said elongated shank to grip the weft as it is being extended;

e. means biasing said weft finger to a normally closed position within said recess of said elongated shank; and f. said elongated weft finger including an arcuated actuating surface defining a camming surface protruding from said recess for effecting pivotal movement of said weft engaging recess to shed lint accumulation from the latter and said elongated shank and release the weft held therebetween in timed sequence with the weaving cycle.

* * * * *